US009238500B2

(12) United States Patent
Namgung et al.

(10) Patent No.: US 9,238,500 B2
(45) Date of Patent: Jan. 19, 2016

(54) CARGO HOLD STRUCTURE FOR A VERY LARGE CRUDE OIL CARRIER

(75) Inventors: Mun Namgung, Bucheon-si (KR); Sang Yong Shon, Seoul (KR); Tae Woon Kang, Seoul (KR)

(73) Assignee: DAEWOO SHIPBUILDING & MARINE ENGINEERING CO., LTD., Seoul (KR)

( * ) Notice: Subject to any disclaimer, the term of this patent is extended or adjusted under 35 U.S.C. 154(b) by 397 days.

(21) Appl. No.: 13/642,876

(22) PCT Filed: Oct. 28, 2010

(86) PCT No.: PCT/KR2010/007451

§ 371 (c)(1), (2), (4) Date: Jan. 2, 2013

(87) PCT Pub. No.: WO2011/136449

PCT Pub. Date: Nov. 3, 2011

(65) Prior Publication Data

US 2013/0118396 A1 May 16, 2013

(30) Foreign Application Priority Data

Apr. 27, 2010 (KR) ..... 10-2010-0038829

(51) Int. Cl.

| | |
|---|---|
| ***B63B 3/26*** | (2006.01) |
| ***B63B 11/02*** | (2006.01) |
| ***B63B 25/08*** | (2006.01) |
| ***B63B 3/34*** | (2006.01) |
| ***B63B 25/12*** | (2006.01) |
| *B63B 3/32* | (2006.01) |
| *B63B 3/28* | (2006.01) |

(52) U.S. Cl.

CPC . *B63B 25/08* (2013.01); *B63B 3/26* (2013.01); *B63B 3/34* (2013.01); *B63B 25/12* (2013.01); *B63B 3/28* (2013.01); *B63B 3/32* (2013.01); *B63B 2701/12* (2013.01); *B63B 2701/18* (2013.01)

(58) Field of Classification Search

CPC ..... B63B 25/08; B63B 25/12–25/16; B63B 3/26–3/36; B63B 11/02; B63B 2025/085; B63B 2025/087; B63B 2701/12; B63B 2701/18; B63B 2701/22; F17C 13/08; F17C 2270/0105; F17C 2270/0107

USPC ..... 114/65 R, 74 R, 74 T, 74 A; 220/560, 220/560.07, 560.11, 901

See application file for complete search history.

(56) References Cited

U.S. PATENT DOCUMENTS 3,978,808 A * 9/1976 Cuneo et al. ..... 114/74 A
5,582,124 A * 12/1996 Sikora et al. ..... 114/74 A (Continued)

*Primary Examiner* — Ajay Vasudeva

(74) *Attorney, Agent, or Firm* — Hoffmann & Baron, LLP

(57) ABSTRACT

A cargo hold structure for an oil tanker is provided, in which a plurality of vertical webs that is mounted on longitudinal bulkheads of the cargo hold in a height direction of a hull is made wide and horizontal girders which connect the vertical webs to each other and support them, thereby controlling the sloshing load of the cargo hold and improving the structural strength of the cargo hold without having to mount crossties. The cargo hold structure includes a longitudinal bulkhead (20) arranged in a lengthwise direction of a hull to divide an internal space, a plurality of vertical webs (22) coupled onto the longitudinal bulkhead (20) in a height direction of the hull, the vertical web (22) having a width of 0.15 to 0.20 times the total height (H) of the cargo hold, and a horizontal girder (24) arranged between the vertical webs (22) in the lengthwise direction of the hull, the level of the horizontal girder (24) being within 30% to 60% of the total height (H) of the cargo hold from the bottom thereof.

7 Claims, 10 Drawing Sheets

(56) References Cited

U.S. PATENT DOCUMENTS 6,907,836 B2 * 6/2005 Hagner ..... 114/74 A
7,077,071 B2 * 7/2006 Neu ..... 114/65 R
2010/0083671 A1 * 4/2010 Liner ..... 62/53.2

* cited by examiner

Fig. 7

Case I (with cross tie)

Longitudinal sloshing in center cargo tank

| | | |
|---|---|---|
| $\rho$ = | 1.025 | tonnes/m³, density of liquid in the tank, and is not to be taken less than 1.025 |
| L = | 316.39 | m, rule length |
| $h_{tank}$ = | 29.000 | m, filling height, measured from inner bottom |
| $n_{wash-t}$ = | 0 | number of transverse wash bulkheads in the tank |
| $n_{wf}$ = | 3 | number of transverse web frames, excluding wash bulkheads, in the tank |
| $f_{wf}$ = | 3 | factor, = $n_{wf}$ / (1 + $n_{wash-t}$) |
| $s_{wf}$ = | 5.64 | m, distance from bulkhead to web frame under consideration |

| No. | Filling ratio | $h_{fill}$ | $l_{tk-h}$ | $A_{tk-t-h}$ | $A_{open-wf-t}$ | $\alpha_{wf}$ | $A_{open-wash-t}$ | $\alpha_{wash-t}$ | $l_{sth}$ | $f_{sth}$ | $P_{sth-lng}$ | $l_{sth-wash}$ | $P_{sth-lng-wash}$ | $p_{sth-wf}$ |
|---|---|---|---|---|---|---|---|---|---|---|---|---|---|---|
| 1 | 0.95 | 27.550 | 51.120 | 628.14 | 428.50 | 0.677 | 628.14 | 1.000 | 36.461 | 0.675 | 72.03 | 0.000 | 20.0 | 51.34 |
| 2 | 0.90 | 26.100 | 51.120 | 595.08 | 413.79 | 0.695 | 595.08 | 1.000 | 37.276 | 0.820 | 78.80 | 0.000 | 20.0 | 56.81 |
| 3 | 0.85 | 24.650 | 51.120 | 562.02 | 390.51 | 0.695 | 562.02 | 1.000 | 37.253 | 0.955 | 81.70 | 0.000 | 20.0 | 58.69 |
| 4 | 0.80 | 23.200 | 51.120 | 528.96 | 364.83 | 0.690 | 528.96 | 1.000 | 37.021 | 0.980 | 82.91 | 0.000 | 20.0 | 59.42 |
| 5 | 0.75 | 21.750 | 51.120 | 495.90 | 339.09 | 0.684 | 495.90 | 1.000 | 36.792 | 0.995 | 83.09 | 0.000 | 20.0 | 59.39 |
| 6 | 0.70 | 20.300 | 51.120 | 462.84 | 312.36 | 0.677 | 462.84 | 1.000 | 36.444 | 1.000 | 82.26 | 0.000 | 20.0 | 58.61 |
| 7 | 0.65 | 18.850 | 51.120 | 429.78 | 287.62 | 0.669 | 429.78 | 1.000 | 36.069 | 0.995 | 80.43 | 0.000 | 20.0 | 57.10 |
| 8 | 0.60 | 17.400 | 51.120 | 396.72 | 261.88 | 0.660 | 396.72 | 1.000 | 35.676 | 0.980 | 77.60 | 0.000 | 20.0 | 54.96 |
| 9 | 0.55 | 15.950 | 51.120 | 363.66 | 236.14 | 0.649 | 363.66 | 1.000 | 35.196 | 0.955 | 73.78 | 0.000 | 20.0 | 51.88 |
| 10 | 0.50 | 14.500 | 51.120 | 330.60 | 210.46 | 0.637 | 330.60 | 1.000 | 34.611 | 0.920 | 69.02 | 0.000 | 20.0 | 48.22 |
| 11 | 0.45 | 13.050 | 51.120 | 297.54 | 186.30 | 0.626 | 297.54 | 1.000 | 34.151 | 0.875 | 64.03 | 0.000 | 20.0 | 44.49 |
| 12 | 0.40 | 11.600 | 51.120 | 264.48 | 178.17 | 0.674 | 264.48 | 1.000 | 36.291 | 0.820 | 66.94 | 0.000 | 20.0 | 47.63 |
| 13 | 0.35 | 10.150 | 51.120 | 231.42 | 161.86 | 0.699 | 231.42 | 1.000 | 37.460 | 0.755 | 65.25 | 0.000 | 20.0 | 46.96 |
| 14 | 0.30 | 8.700 | 51.120 | 198.36 | 136.82 | 0.690 | 198.36 | 1.000 | 37.044 | 0.680 | 57.59 | 0.000 | 20.0 | 41.29 |
| 15 | 0.25 | 7.250 | 51.120 | 165.30 | 111.61 | 0.675 | 165.30 | 1.000 | 36.360 | 0.595 | 48.74 | 0.000 | 20.0 | 34.70 |
| 16 | 0.20 | 5.800 | 51.120 | 132.24 | 86.33 | 0.653 | 132.24 | 1.000 | 35.344 | 0.500 | 38.94 | 0.000 | 20.0 | 27.43 |
| 17 | 0.15 | 4.350 | 51.120 | 99.18 | 61.29 | 0.618 | 99.18 | 1.000 | 33.760 | 0.395 | 28.35 | 0.000 | 20.0 | 20.00 |
| 18 | 0.10 | 2.900 | 51.120 | 66.12 | 37.42 | 0.566 | 66.12 | 1.000 | 31.395 | 0.280 | 20.00 | 0.000 | 20.0 | 20.00 |
| 19 | 0.05 | 1.450 | 51.120 | 33.06 | 16.07 | 0.486 | 33.06 | 1.000 | 27.761 | 0.155 | 20.00 | 0.000 | 20.0 | 20.00 |
| | | | | | | | Maximum Sloshing Pressure : | | | | 83.1 | | 20.0 | 58.4 |

Fig. 8

Case II (without cross tie + web depth increase)

Longitudinal sloshing in center cargo tank

| | | |
|---|---|---|
| $\rho$ = | 1.025 | tonnes/m$^3$, density of liquid in the tank, and is not to be taken less than 1.025 |
| $L$ = | 318.39 | m, tank length |
| $h_{full}$ = | 29.000 | m, filling height, measured from inner bottom |
| $n_{wash-t}$ = | 0 | number of transverse wash bulkheads in the tank |
| $n_w$ = | 0 | number of transverse web frames, excluding wash bulkheads, in the tank |
| $f_w$ = | 0 | factor, = $n_w$ / (1 + $n_{wash-t}$) |
| $x_w$ = | 5.69 | m, distance from bulkhead to web frame under consideration |

| No. | Filling ratio | $h_{liq}$ | $l_{tk-h}$ | $A_{tk-t-h}$ | $A_{open-wt-t}$ | $\alpha_{wt}$ | $A_{open-wash-t}$ | $\alpha_{wash-t}$ | $l_{stk}$ | $f_{stk}$ | $P_{stk-lng}$ | $l_{stk-wash}$ | $P_{stk-lng-wash}$ | $P_{stk-wt}$ |
|---|---|---|---|---|---|---|---|---|---|---|---|---|---|---|
| 1 | 0.95 | 27.550 | 51.120 | 629.14 | 416.58 | 0.663 | 629.14 | 1.000 | 35.918 | 0.975 | 69.77 | 0.000 | 20.0 | 49.40 |
| 2 | 0.90 | 26.100 | 51.120 | 595.08 | 406.55 | 0.683 | 595.08 | 1.000 | 36.724 | 0.920 | 76.72 | 0.000 | 20.0 | 54.82 |
| 3 | 0.85 | 24.650 | 51.120 | 562.02 | 383.83 | 0.683 | 562.02 | 1.000 | 36.715 | 0.865 | 79.59 | 0.000 | 20.0 | 56.87 |
| 4 | 0.80 | 23.200 | 51.120 | 528.96 | 360.03 | 0.681 | 528.96 | 1.000 | 36.608 | 0.980 | 81.26 | 0.000 | 20.0 | 58.00 |
| 5 | 0.75 | 21.750 | 51.120 | 495.90 | 336.17 | 0.678 | 495.90 | 1.000 | 36.494 | 0.995 | 82.01 | 0.000 | 20.0 | 58.46 |
| 6 | 0.70 | 20.300 | 51.120 | 462.84 | 312.32 | 0.675 | 462.84 | 1.000 | 36.343 | 1.000 | 81.95 | 0.000 | 20.0 | 58.26 |
| 7 | 0.65 | 18.850 | 51.120 | 429.78 | 288.47 | 0.671 | 429.78 | 1.000 | 36.179 | 0.995 | 80.78 | 0.000 | 20.0 | 57.41 |
| 8 | 0.60 | 17.400 | 51.120 | 396.72 | 264.75 | 0.667 | 396.72 | 1.000 | 36.004 | 0.980 | 79.83 | 0.000 | 20.0 | 55.95 |
| 9 | 0.55 | 15.950 | 51.120 | 363.66 | 240.90 | 0.662 | 363.66 | 1.000 | 35.790 | 0.955 | 76.02 | 0.000 | 20.0 | 53.80 |
| 10 | 0.50 | 14.500 | 51.120 | 330.60 | 217.06 | 0.657 | 330.60 | 1.000 | 35.514 | 0.920 | 72.26 | 0.000 | 20.0 | 50.99 |
| 11 | 0.45 | 13.050 | 51.120 | 297.54 | 193.46 | 0.650 | 297.54 | 1.000 | 35.225 | 0.875 | 67.73 | 0.000 | 20.0 | 47.65 |
| 12 | 0.40 | 11.600 | 51.120 | 264.48 | 172.55 | 0.652 | 264.48 | 1.000 | 35.325 | 0.820 | 63.80 | 0.000 | 20.0 | 44.93 |
| 13 | 0.35 | 10.150 | 51.120 | 231.42 | 150.26 | 0.649 | 231.42 | 1.000 | 35.185 | 0.755 | 58.32 | 0.000 | 20.0 | 41.01 |
| 14 | 0.30 | 8.700 | 51.120 | 198.36 | 128.54 | 0.648 | 198.36 | 1.000 | 34.669 | 0.680 | 51.16 | 0.000 | 20.0 | 35.77 |
| 15 | 0.25 | 7.250 | 51.120 | 165.30 | 102.78 | 0.622 | 165.30 | 1.000 | 33.928 | 0.595 | 43.08 | 0.000 | 20.0 | 29.86 |
| 16 | 0.20 | 5.800 | 51.120 | 132.24 | 79.00 | 0.597 | 132.24 | 1.000 | 32.828 | 0.500 | 34.14 | 0.000 | 20.0 | 23.35 |
| 17 | 0.15 | 4.350 | 51.120 | 99.18 | 55.60 | 0.561 | 99.18 | 1.000 | 31.152 | 0.395 | 24.59 | 0.000 | 20.0 | 20.00 |
| 18 | 0.10 | 2.900 | 51.120 | 66.12 | 33.78 | 0.511 | 66.12 | 1.000 | 28.697 | 0.280 | 20.00 | 0.000 | 20.0 | 20.00 |
| 19 | 0.05 | 1.450 | 51.120 | 33.06 | 14.61 | 0.442 | 33.06 | 1.000 | 25.759 | 0.155 | 20.00 | 0.000 | 20.0 | 20.00 |
| | | | | | | | Maximum Sloshing Pressure : | | | | 82.0 | | 20.0 | 58.5 |

CARGO HOLD STRUCTURE FOR A VERY LARGE CRUDE OIL CARRIER

This application is the U.S. National Phase of, and Applicants claim priority from, International Application No. PCT/KR2010/007451 filed Oct. 28, 2010 and Korean Patent Application No. 10-2010-0038829 filed Apr. 27, 2010, each of which are incorporated herein by reference.

BACKGROUND OF THE INVENTION

The present invention relates, in general, to a cargo hold structure for an oil tanker and, more particularly, to a cargo hold structure for an oil tanker, in which instead of mounting a crosstie between longitudinal bulkheads of a cargo hold to support the cargo hold, a vertical web mounted on the longitudinal bulkhead is made wide and a horizontal girder is connected between the vertical webs, thereby controlling the sloshing of a load in the cargo hold and improving the structural strength of the cargo hold.

Generally, a very large crude oil carrier (VLCC) is configured so that a cargo hold is divided into three spaces by means of two longitudinal bulkheads, wherein a reinforcing member such as a crosstie is mounted between vertical webs in order to support the longitudinal bulkheads.

That is, as shown in FIGS. 1 to 3, an oil tanker is configured so that a cargo hold having a closed space is defined by a deck 51, an inner bottom plate 53, and left/right side shells 55, a deck transverse is vertically arranged onto the deck 51 in a horizontal direction of a hull, and a girder 59 is arranged on the inner bottom plate 53 in the horizontal direction of the hull.

In this case, the cargo hold is provided so that an inner space is defined by the longitudinal bulkheads 61 that are vertically arranged in the lengthwise direction of the hull between the deck 51 and the inner bottom plate 53, and the deck 51 and the inner bottom plate 53 are interconnected by a vertical web 63 that is mounted along a width direction of the hull and vertically to the hull. Here, the vertical web 63 is a rectangular reinforcing plate with a width about 0.1 times the total height H of the cargo hold. The vertical webs are arranged at multi-points on the entire face of the longitudinal bulkhead and spaced apart by intervals of a predetermined distance in the lengthwise direction of the hull.

The plurality of vertical webs 63 are interconnected by the plurality of crossties 65 that are horizontally arranged along the width direction of the hull. The crossties 65 also serve as a reinforcing member like the vertical webs 63. Thus, the longitudinal bulkhead 61 can secure a proper structural strength by the vertical webs 63 and the crossties 65 connecting the vertical webs.

Furthermore, the vertical webs 63 are interconnected by a plurality of stiffeners 67, which are horizontally arranged along a lengthwise direction of the hull and have a size relatively smaller than the vertical webs 63. Here, the stiffeners 67 are arranged in a stacked form with certain intervals in the height direction of the hull between the vertical webs 63. Thus, the longitudinal bulkhead 61 can secure a proper structural strength furthermore by the combination of the vertical webs 63, the crossties 65, and the stiffeners 67.

However, in the cargo hold of the conventional oil tanker having the above-mentioned construction, the crosstie 65 is of a heavy structure that is suspended in the space in the cargo hold so as to interconnect the vertical webs 63, so that the crosstie becomes vulnerable to vibrations of the hull and to the sloshing of a load of fluid stored in the cargo hold that takes place as the ship travels.

Further, in the VLCC in which two longitudinal bulkheads 61 divide the inside of the cargo hold, since the structure of the cargo hold may be damaged because of the crossties 65 being connected between the vertical webs 63, the VLCC may be vulnerable to marine safety accidents, and much time and cost are taken when manufacturing the VLCC.

Moreover, according to the rules of Safety Of Life At Sea (SOLAS), a safety device is required that can examine and maintain the safety of the crossties 65 is also needed after delivery of a vessel to a shipowner, so that the manufacturing cost of a vessel problematically increases by even more.

SUMMARY OF THE INVENTION

Accordingly, the present invention has been made keeping in mind the above problems occurring in the related art, and is intended to provide a cargo hold structure for an oil tanker, in which a plurality of vertical webs that is mounted on longitudinal bulkheads of the cargo hold and that is set up in a height direction of a hull, is made wide and horizontal girders are connected between the vertical webs to support them, thereby controlling the sloshing of a load of the cargo hold and improving the structural strength of the cargo hold without having to mount crossties.

Technical Solution

In an aspect, the present invention provides a cargo hold structure for an oil tanker including a longitudinal bulkhead arranged in a lengthwise direction of a hull to divide an internal space, a plurality of vertical webs coupled onto the longitudinal bulkhead in a height direction of the hull, the vertical web having a width of 0.15 to 0.20 times the total height of the cargo hold, and a horizontal girder arranged between the vertical webs in the lengthwise direction of the hull, the level of the horizontal girder being within 30 to 60% of the total height of the hull from the bottom of the cargo hold.

In an exemplary embodiment, the vertical webs may be interconnected by a plurality of stiffeners, which are arranged in a lengthwise direction of the hull and disposed in a stacked form in a height direction of the hull between the vertical webs.

In an exemplary embodiment, the horizontal girder and the stiffener may have first ends connected to the longitudinal bulkhead and second ends exposed to the inside of the cargo hold.

In an exemplary embodiment, the horizontal girder may have a width that is equal to or smaller than that of the vertical web.

Advantageous Effects

According to the cargo hold structure for an oil tanker, two adjacent longitudinal bulkheads in the cargo hold are not connected by the crossties, but the vertical webs are interconnected by the horizontal girders while the width of the vertical web is enlarged, so that proper sloshing performance of the cargo hold can be secured, and the structural strength of the cargo hold can also be maintained in a proper design level.

Particularly, the width of the vertical web is increased to a specified value relative to the total height of the cargo hold, and the vertical webs are interconnected and supported by the horizontal girders, so that compared to the conventional construction in which the vertical webs are interconnected by the crossties, the weight can be reduced and the manufacturing time and cost can also be reduced considerably.

Furthermore, despite the exclusion of the crossties, an increase in the width of the vertical web and the mounting of the horizontal girders between the vertical webs can ensure that the sloshing load and the structural strength are well controlled, which are required of a cargo hold, and the time and cost for examination and maintenance of the crossties can be omitted.

BRIEF DESCRIPTION OF THE DRAWINGS

FIGS. 7 and 8 are diagrams illustrating results of calculating the sloshing of a load in the cargo hold of an oil tanker according to the related art and the present invention.

BRIEF DESCRIPTION OF THE REFERENCE NUMERALS OF THE DRAWINGS

10: Deck, 12: Inner Bottom Plate, 14: Side Shell, 16: Deck Transverse, 18: Girder, 20: Longitudinal Bulkhead, 22: Vertical Web, 24: Horizontal Girder, 26: Stiffener

DETAILED DESCRIPTION OF THE INVENTION

Hereinbelow, preferred embodiments of the present invention will be described in detail with reference to the accompanying drawings.

Figure 1:
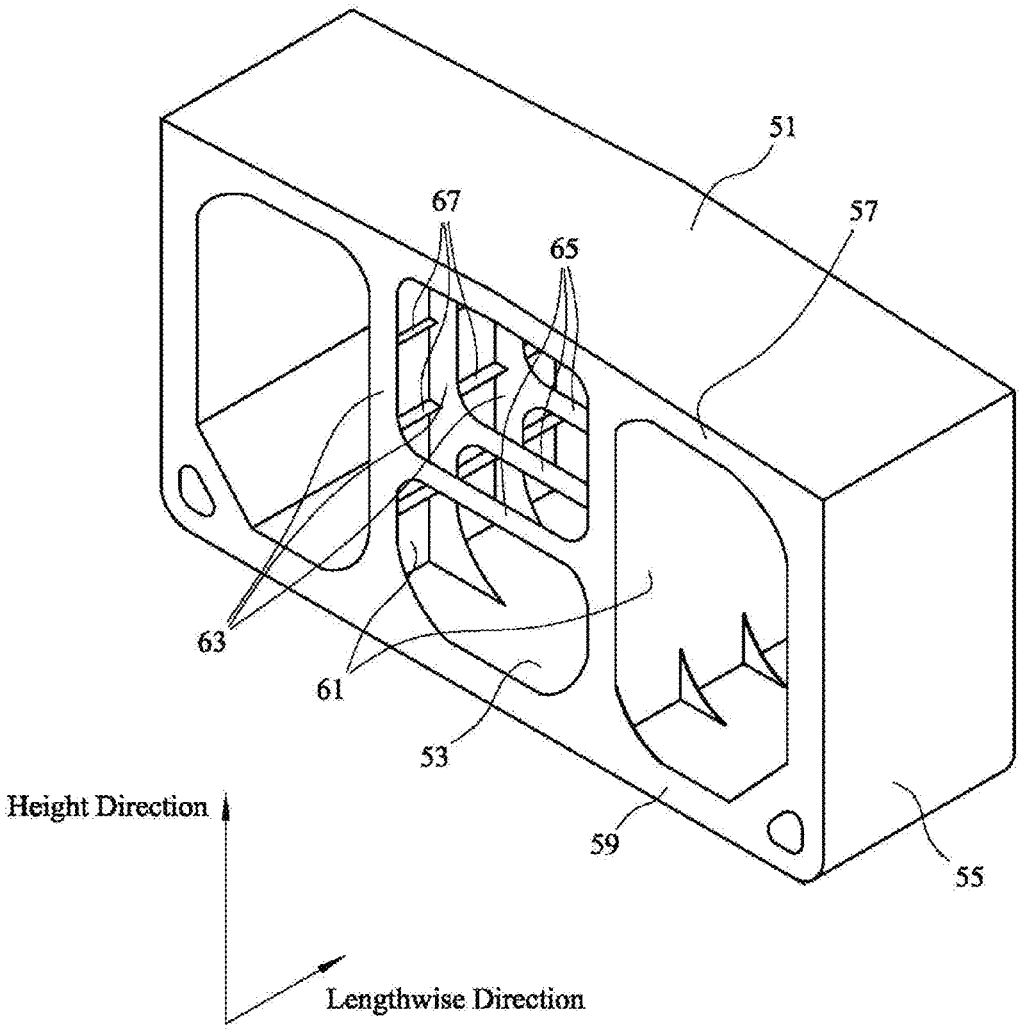
Fig. 1 Prior Art
FIG. 1 is a perspective view partially illustrating a cargo hold structure for a conventional oil tanker.
Figure 2:
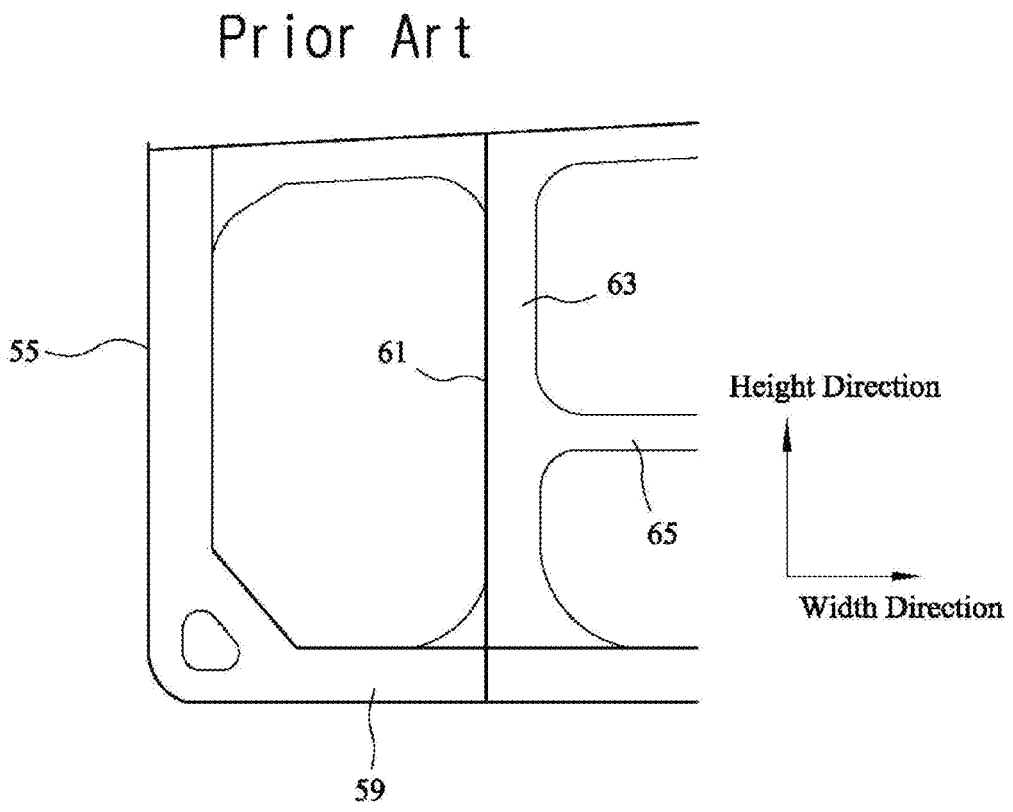
FIG. 2 is a partial longitudinal-sectional view of the cargo hold structure of FIG. 1.
Figure 3:
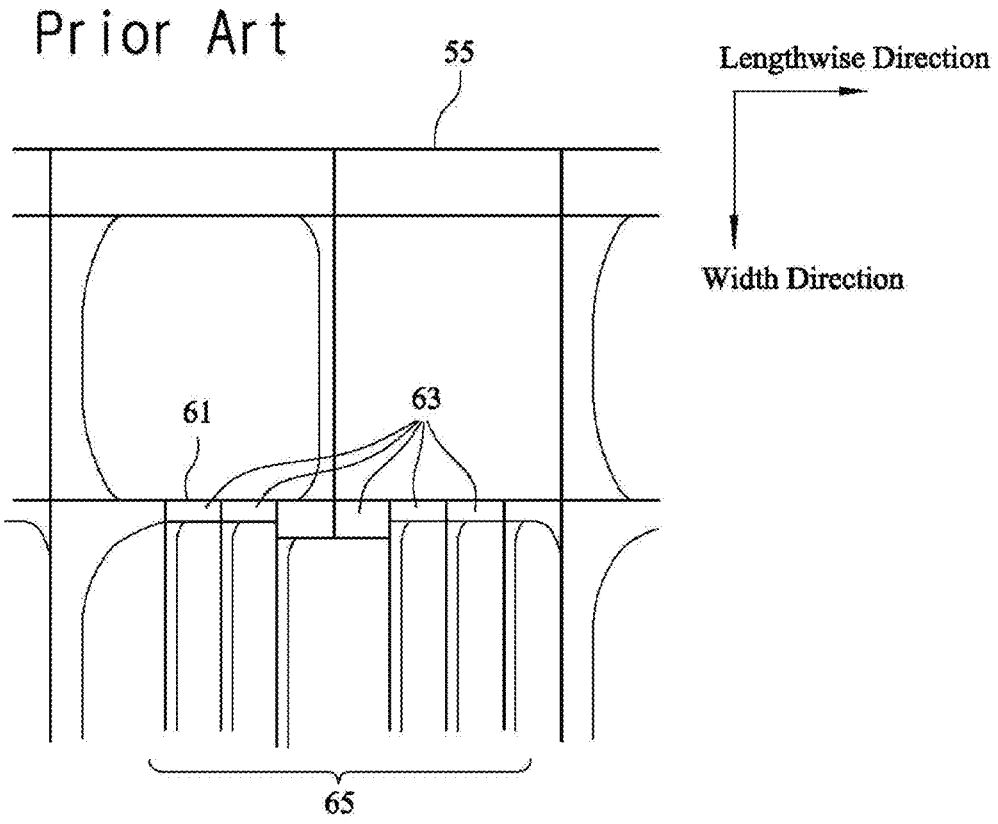
FIG. 3 is a partial cross-sectional view of the cargo hold structure of FIG. 1.
Figure 4:
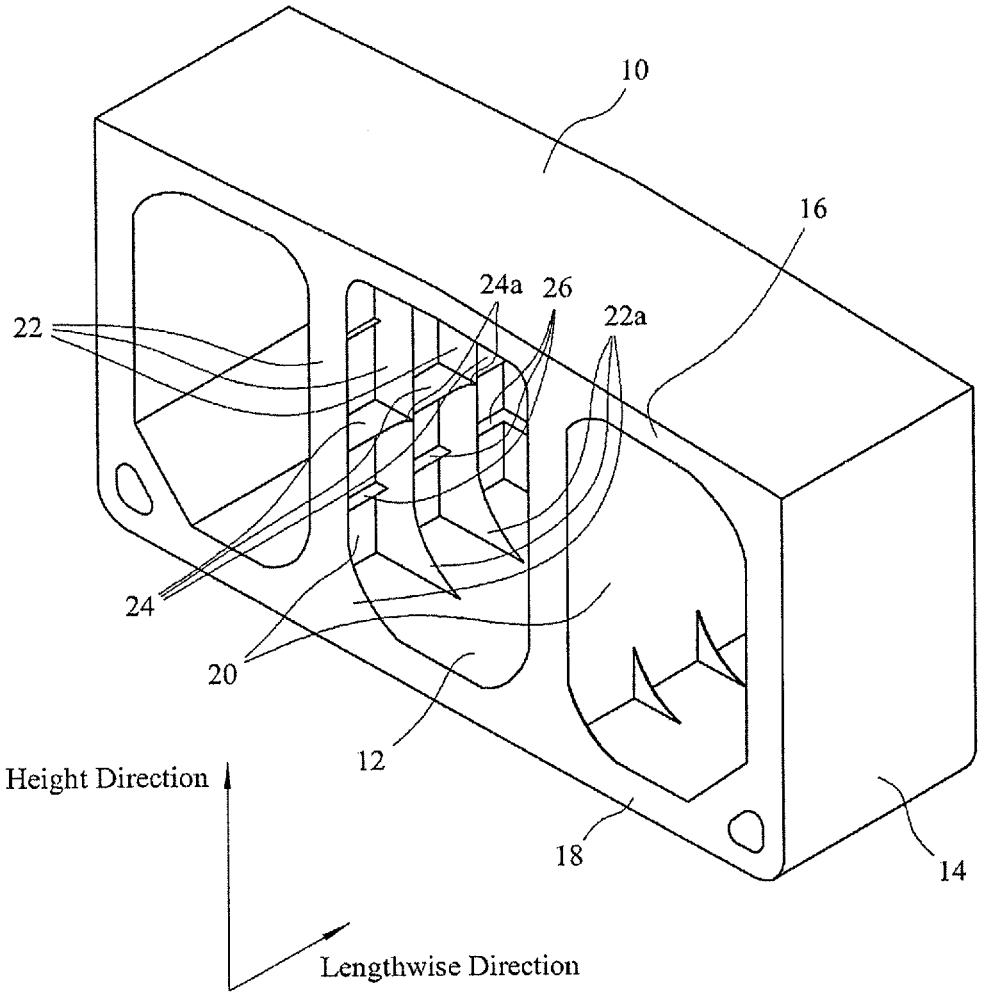
FIG. 4 is a perspective view partially illustrating a cargo hold structure for an oil tanker according to an embodiment.
Figure 5:
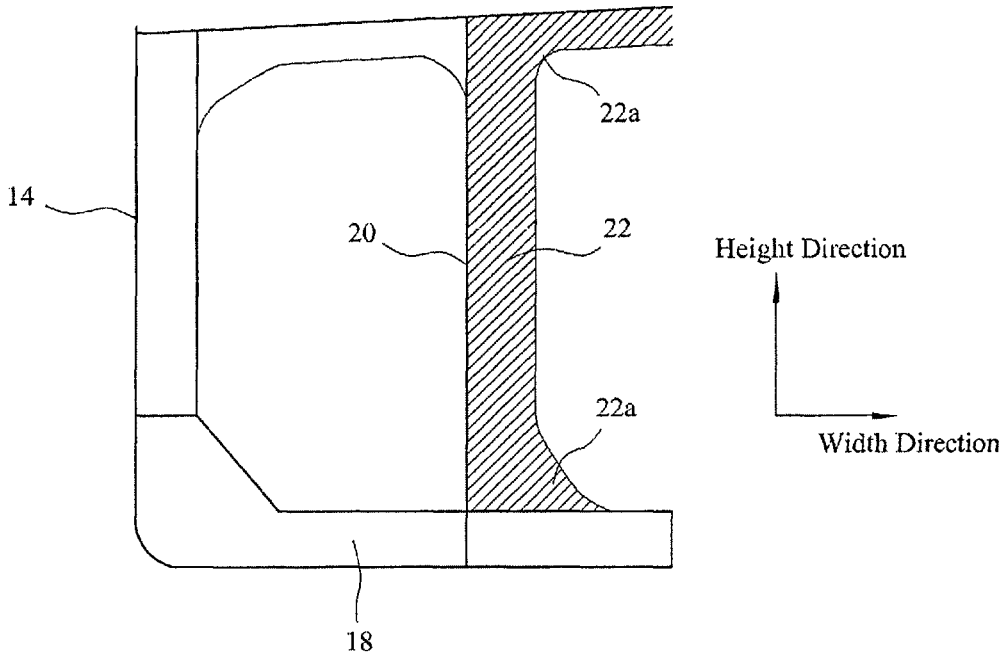
FIG. 5 is a longitudinal-sectional view partially illustrating the cargo hold structure of FIG. 4.
Figure 6:
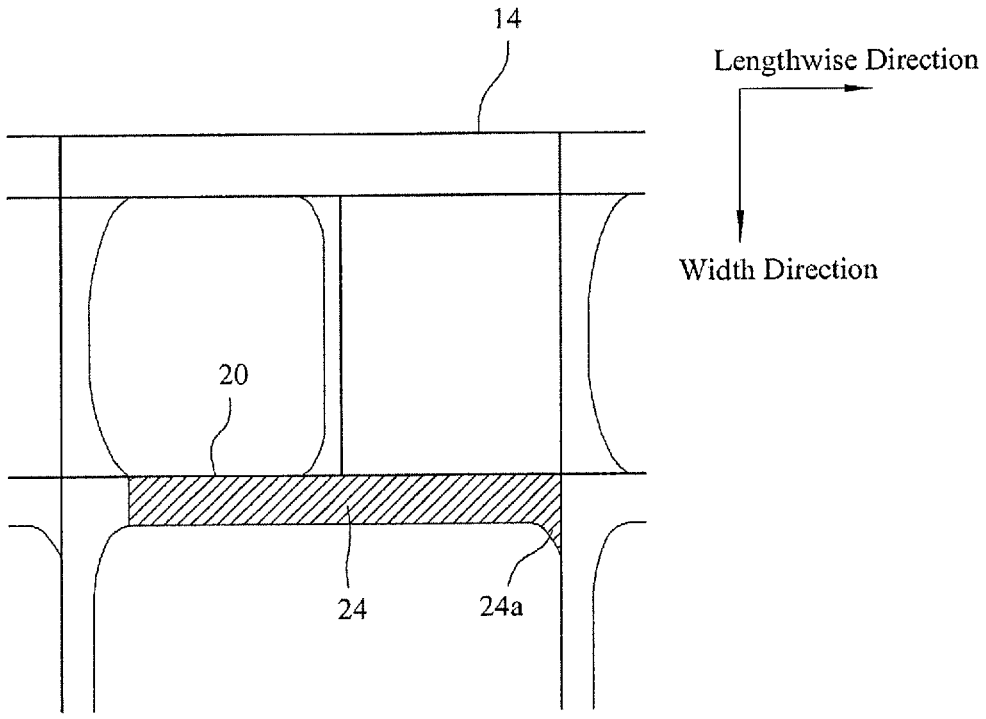
FIG. 6 is a cross-sectional view partially illustrating the cargo hold structure of FIG. 4.

As shown in FIG. 4, a cargo hold for an oil tanker has a closed internal space that is defined by a deck 10, an inner bottom plate 12, and left/right side shells 14 to contain therein a fluid such as oil. Here, a deck transverse 16 is vertically arranged on the deck 10 in a horizontal direction of a hull, and a girder 18 is vertically arranged on the inner bottom plate 12 in a horizontal direction of the hull. The internal space of the cargo hold is divided by longitudinal bulkheads 20 which are vertically arranged along the lengthwise direction of the hull between the deck 10 and the inner bottom plate 12.

The cargo hold having the above construction is adapted to a Very Large Crude Oil Carrier (VLCC) (about at least 300,000 tonnage) having the total height H of 25 m or more and the whole width W of 58 m, 60 m or more, wherein the internal space of the cargo hold is divided along the width direction of the hull into three compartments by two longitudinal bulkheads 20 that are arranged in the lengthwise direction of the hull. That is, the cargo hold of the VLCC is divided into a center hold part and left/right hold parts arranged on the left/right sides of the center hold part by means of the two longitudinal bulkheads 20.

The deck 10 and the inner bottom plate 12 are interconnected by a plurality of vertical webs 22, which are vertically arranged along the width direction of the hull. The plurality of vertical webs 22 is one of the reinforcing members and they are arranged spaced apart at certain intervals over the entire surface of the longitudinal bulkhead along the lengthwise direction of the hull. Further, the vertical web 22 is provided at its end portion with a first reinforcing part 22*a*, a width of which gradually increases so that a free end thereof is made into a round shape to distribute stress. The first reinforcing part 22*a* is coupled to a target place of the deck 10 and the inner bottom plate 12 or the deck transverse 16 and the girder 18, together with the end portion of the vertical web 22. Thus, the longitudinal bulkheads 20 can guarantee a proper amount of structural strength thanks to the plurality of vertical webs 22. In this case, the vertical web 22 is comprised of a rectangular reinforcing plate that has a width of about 0.15 to 0.20, preferably 0.18 times the total height H of the cargo hold.

The plurality of vertical webs 22 are interconnected by a plurality of horizontal girders 24, one of the reinforcing members, which are horizontally arranged in a lengthwise direction of the hull between the vertical webs 22. Further, the horizontal girder 24 is provided at its end portion with a second reinforcing part 24*a*, a width of which gradually increases so that a free end thereof is made into a round shape to distribute stress. The second reinforcing part 24*a* is coupled to the vertical web 22, together with the end portion of the horizontal girder 24. Thus, the longitudinal bulkheads 20 can secure a proper structural strength using the plurality of vertical webs 22 and the horizontal girders 24 mounted between the vertical webs 22.

Moreover, the horizontal girder 24 is welded at one width end to the longitudinal bulkhead such that the other width end is exposed to the inside of the cargo hold, and is interconnected at both lengthwise ends between the vertical webs 22. In this case, the horizontal girders 24 are connected between the vertical webs 22 at a level of about 30% to 60% of the total height H of the cargo hold. Here, the mounting height of the horizontal girder 24 is of course set from the inner bottom plate 12 that corresponds to the bottom of the cargo hold. Further, the width of the horizontal girder 24 is set to a value equal to or smaller than the width of the vertical web 22.

Meanwhile, the vertical webs 22 are interconnected by a plurality of stiffeners 26. The stiffeners 26 are horizontally arranged in the lengthwise direction of the hull. The stiffeners 26 are arranged, at a region except for spots where the horizontal girders 24 are mounted, in a stacked form with certain intervals in the height direction of the hull between the vertical webs 22. Thus, the longitudinal bulkhead 20 can secure a proper structural strength by means of the vertical webs 22, the horizontal girders 24, and the stiffeners 26. Further, the stiffener 26 is welded at one width end to the longitudinal bulkhead 20 such that the other width end is exposed to the inside of the cargo hold, and is interconnected at both lengthwise ends between the vertical webs 22.

Hereinafter, in order to contrast the cargo hold structure of an oil tanker of the related art with that of the present invention, variations in the sloshing of a load in relation to an increase in the width of the vertical web and variations in the structural strength in relation to the installation of the horizontal girders will be examined and analyzed in detail.

First, the sloshing loads of the two types of cargo holds will be compared as the width length of the vertical web 22, which is arranged vertical to the hull and in the width direction of the hull between the deck 10 and the inner bottom plate 12, by having width of an amount of about 0.15 to 0.20 times the total height H of the cargo hold.

As shown in FIGS. 7 and 8, the maximum sloshing load in the center hold part of the cargo hold of the related art in which the longitudinal bulkheads 20 are connected by means of the crossties was calculated as 83.1 kPa, and the maximum sloshing load in the center hold part of the cargo hold of the present invention in which the width of the vertical web 22 is increased by a predetermined value was calculated as 82.0 kPa. Thus, in contrast to the related art cargo hold using the crossties, the cargo hold of the present invention can obtain a sloshing load that is substantially equal to the related art just by increasing the width of the vertical web 22 without resorting to using the crossties.

In other words, the cargo hold of the present invention can obtain the sloshing load that the conventional cargo hold using the crossties generates, by only increasing the width of the vertical web, without mounting the crossties.

Further, in contrast of the cargo hold structure of an oil tanker of the related art in which the longitudinal bulkheads 20 are connected by means of the crossties, the structural strength of the present cargo hold in which the width of the vertical web 22 is increased by a predetermined value, and the vertical webs 22 are interconnected by means of the horizontal girders 24 will be examined and analyzed as follows.

Figure 9:
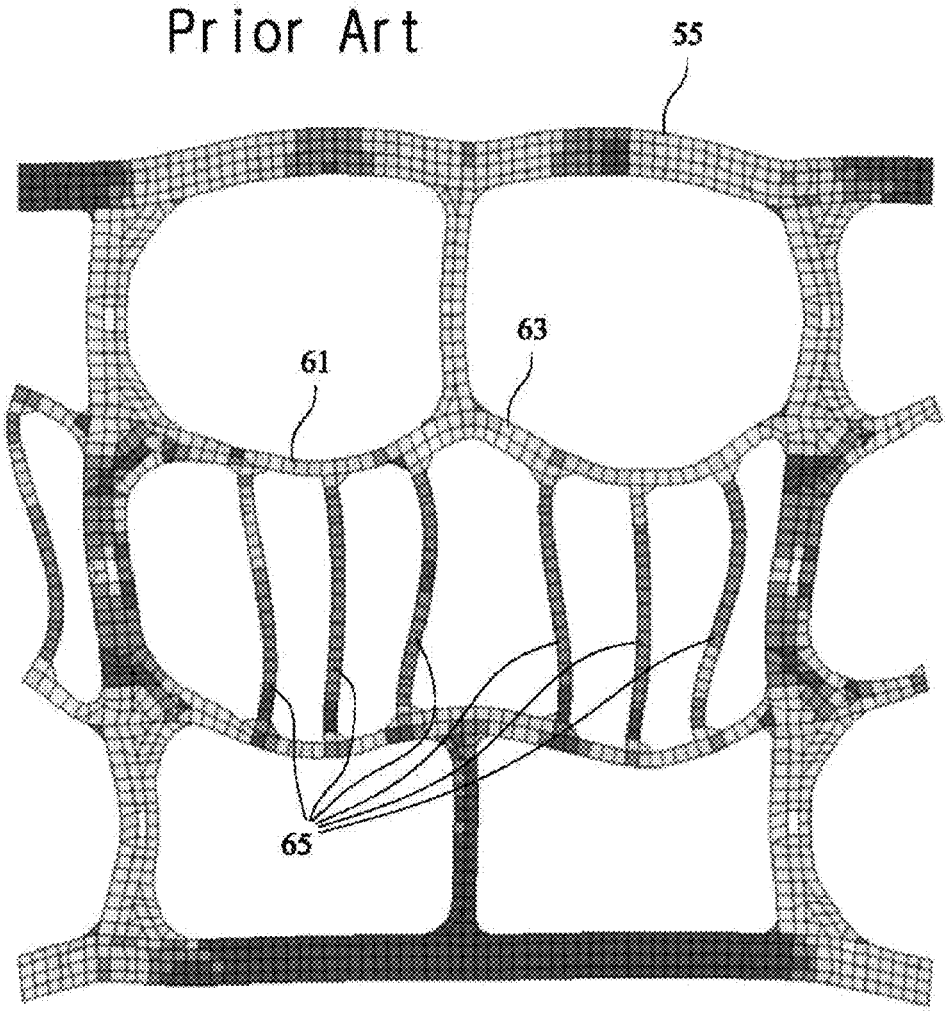
FIGS. 9 and 10 are diagrams illustrating results of structural analysis of the cargo hold according to the related art and the present invention.
Figure 10:
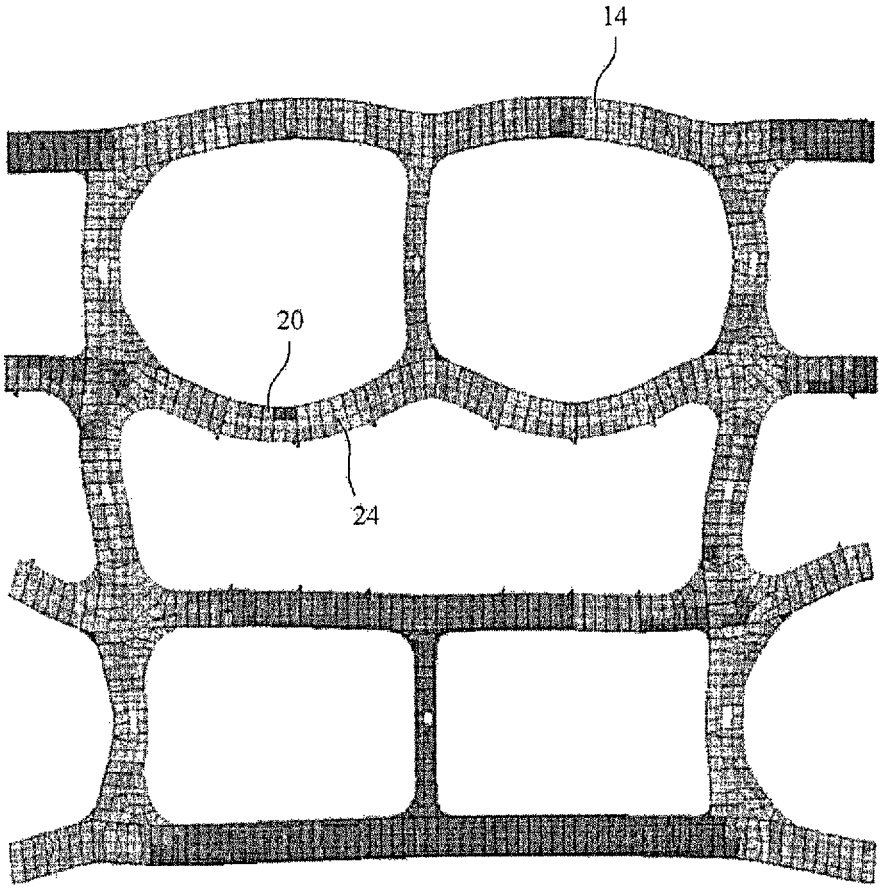

As shown in FIGS. 9 and 10, it can be seen that the structural strength of the present cargo hold in which the vertical webs 22 are interconnected by means of the horizontal girders 24 while the width of the vertical web 22 is increased is substantially similar to the structural strength of the conventional cargo hold in which the longitudinal bulkheads 20 are interconnected by means of the crossties. This can be easily understood from the fact that a similar level of stress distribution is displayed using similar colors. Particularly, when the mounting level of the horizontal girder 24 is set to about 30% to 60% of the total height H of the cargo hold, it can be seen that the structural strength becomes similar to that of the conventional cargo hold using the crossties.

Consequently, the present invention can secure a desired design strength of the cargo hold by connecting the vertical webs 22 using the horizontal girders 24, without horizontally connecting the center portion of the longitudinal bulkheads 20, which divide the inside of the cargo hold into multi-compartments, using the crossties.

That is, when the vertical webs 22 are interconnected by means of the horizontal girders 24, instead of using the crossties, the structural strength that resists the sloshing load of the cargo hold is substantially of the same strength as that of the conventional cargo hold using the crossties as revealed by the calculation results of the structural strength in FIGS. 7 and 8, and also has substantially the same stress distribution as that of the conventional cargo hold as displayed by the similar colors as shown in FIGS. 9 and 10 so that the desired structural strength of the cargo hold in which the vertical webs 22 are interconnected by the horizontal girders 24 can be obtained without using the crossties.

In other words, when the width of the vertical web 22 is increased by a predetermined value, and the vertical webs 22 are interconnected by the horizontal girders 24, the performance of controlling the sloshing load and the structural strength that are required for the cargo hold can be secured, which excludes the mounting of the crossties so that there is no need to spend time and money to examine and maintain the crossties.

Although the embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A cargo hold structure for a very large crude oil carrier comprising:

two longitudinal bulkheads respectively having first and second sides and arranged in a lengthwise direction of a hull to divide an internal space, wherein the internal space is adapted for holding crude oil on the first and second sides of the longitudinal bulkheads, and wherein no crossties are attached to the two longitudinal bulkheads;

a plurality of vertical webs coupled onto the two longitudinal bulkheads in a height direction of the hull, the vertical web having a width of 0.15 to 0.20 times the total height (H) of the cargo hold; and a horizontal girder arranged between the vertical webs along the lengthwise direction of the hull.

2. The cargo hold structure for a very large crude oil carrier according to claim 1, wherein the level of the horizontal girder is within 30% to 60% of the total height (H) of the cargo hold from the bottom thereof.

3. The cargo hold structure for a very large crude oil carrier according to claim 1, wherein the vertical webs are interconnected by a plurality of stiffeners, which are arranged in a lengthwise direction of the hull and disposed in a stacked form in a height direction of the hull between the vertical webs.

4. The cargo hold structure for a very large crude oil carrier according to claim 3, wherein the horizontal girder and the stiffener have first ends that are connected to the longitudinal bulkheads.

5. The cargo hold structure for a very large crude oil carrier according to claim 1, wherein the horizontal girder has a width that is equal to or smaller than that of the vertical web.

6. The cargo hold structure for a very large crude oil carrier according to claim 1, wherein an end portion of the vertical web is integrally provided with a first reinforcing part, a width of which gradually increases so that a free end portion thereof is formed into a circular rounded portion, the first reinforcing part being coupled to a target site of a deck and an inner bottom plate, or a deck transverse and a girder.

7. The cargo hold structure for a very large crude oil carrier according to claim 1, wherein an end portion of the horizontal girder is integrally provided with a second reinforcing part, a width of which gradually increases so that a free end portion thereof is formed into a circular rounded portion, the second reinforcing part being coupled to the vertical web.

* * * * *